US006390038B1

(12) United States Patent
Di Lieto et al.

(10) Patent No.: US 6,390,038 B1
(45) Date of Patent: May 21, 2002

(54) METHOD FOR PROTECTION AGAINST OVERHEATING OF ELECTROMAGNETIC ACTUATORS FOR ACTUATION OF INTAKE AND EXHAUST VALVES IN INTERNAL-COMBUSTION ENGINES

(75) Inventors: Nicola Di Lieto, Salerno; Gilberto Burgio, Ferrara; Roberto Flora, Forli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/855,707

(22) Filed: May 16, 2001

(30) Foreign Application Priority Data

May 16, 2000 (IT) ..... BO2000A0293

(51) Int. Cl.[7] ..... F01L 9/04
(52) U.S. Cl. ..... 123/90.11
(58) Field of Search ..... 123/90.11, 90.19; F01L 9/04, 3/14

(56) References Cited

U.S. PATENT DOCUMENTS 5,596,956 A * 1/1997 Ogawa et al. ..... 123/90.11

FOREIGN PATENT DOCUMENTS

| | | |
|---|---|---|
| DE | 19821551 | 2/2000 |
| DE | 19852169 | 3/2000 |
| EP | 0717172 | 6/1996 |
| JP | 05163912 | 6/1993 |

* cited by examiner

*Primary Examiner*—Thomas Denion
*Assistant Examiner*—Sean D. O'Brien
(74) *Attorney, Agent, or Firm*—Venable; Robert Kinberg

(57) ABSTRACT

Method for protection against overheating of electromagnetic actuators for actuation of intake and exhaust valves in internal-combustion engines, in which an actuator of an engine is connected to a respective intake or exhaust valve, and includes a mobile unit which is actuated magnetically, in order to control the movement of the said valve, and a first and a second electromagnet, which are disposed on opposite sides of the mobile unit; the actuator also being connected to a control unit, via a piloting circuit, which supplies at least one current to a current-measuring circuit, which supplies to the control unit measured values of the current. The method includes the steps of: estimating for each first and second electromagnet, a temperature value $T_{K+1}$ which is updated on the basis of a present temperature value $T_K$ and of the measured values of the current; checking whether the updated temperature value $T_K$ is lower than a threshold; and implementing protective action, if the updated temperature value $T_K$ is higher than the first threshold.

7 Claims, 2 Drawing Sheets

METHOD FOR PROTECTION AGAINST OVERHEATING OF ELECTROMAGNETIC ACTUATORS FOR ACTUATION OF INTAKE AND EXHAUST VALVES IN INTERNAL-COMBUSTION ENGINES

The present invention relates to a method for protection against overheating of electromagnetic actuators for actuation of intake and exhaust valves in internal-combustion engines.

BACKGROUND OF THE INVENTION

As is known, propulsion units are currently at an experimental stage, in which the actuation of the intake and exhaust valves is controlled by means of use of actuators of an electromagnetic type, which replace the purely mechanical distribution systems (cam shafts).

In particular, these actuators comprise a pair of electromagnets disposed on opposite sides of a mobile ferromagnetic element, which is connected to a respective intake or exhaust valve, and is maintained in a position of rest by means of resilient elements (for example a spring and/or a torsion bar). The mobile ferromagnetic element is actuated by means of application of a force generated by distributing suitable currents to the electromagnets, such that the element is made to abut alternately one or the other of the electromagnets themselves, so as to move the corresponding valve between the positions of closure and maximum opening, according to required times and paths. By this means, it is possible to actuate the valves according to optimum raising conditions in all operative conditions of the engine, thus improving substantially the overall performance.

However, in the aforementioned electromagnetic actuators, a serious problem can arise when particularly high currents are distributed. In fact, as a result of, for example, a temporary or permanent malfunctioning, the currents which are supplied to the actuators can assume values which are substantially higher than those planned for the normal functioning conditions. In these cases, the power absorbed can cause sudden overheating of the windings of the electromagnets, and damage them in a few milliseconds in a manner which can even be irreparable. In addition, breakage of the windings makes it impossible to control opening and closure of the valves, and consequently makes the propulsion unit unusable until maintenance intervention is carried out, to replace the faulty actuator(s). In addition, if the cause of the overheating is not correctly determined and eliminated, a high risk of further faults persists.

SUMMARY OF THE INVENTION

The object of the present invention is to provide a method for protection against overheating, which makes it possible to overcome the disadvantages described, and which, in particular, makes it possible to reduce the risk of breakage of the windings of the electromagnets.

According to the present invention, a method is provided for protection against overheating of electromagnetic actuators for actuation of intake and exhaust valves in internal-combustion engines, in which an actuator of an engine is connected to a respective intake or exhaust valve, and comprises a mobile unit which is actuated magnetically, in order to control the movement of the said valve, and a first and a second electromagnet, which are disposed on opposite sides of the said mobile unit; the said actuator also being connected to a control unit, via piloting means which supply at least one current, and to current-measuring means; the said current-measuring means supplying to the said control unit measured values of the said at least one current;

the method being characterised in that it comprises the steps of:

a) estimating for each of the said first and second electromagnets, a temperature value which is updated on the basis of a present temperature value and of the said measured values of the said at least one current;

b) checking whether the said updated temperature value is lower than a first threshold; and c) implementing protective action, if the updated temperature value is higher than the said first threshold.

BRIEF DESCRIPTION OF THE DRAWINGS

In order to assist understanding of the invention, an embodiment is now described, purely by way of non-limiting example, and with reference to the attached drawings, in which.

DETAILED DESCRIPTION OF THE INVENTION

Figure 1:
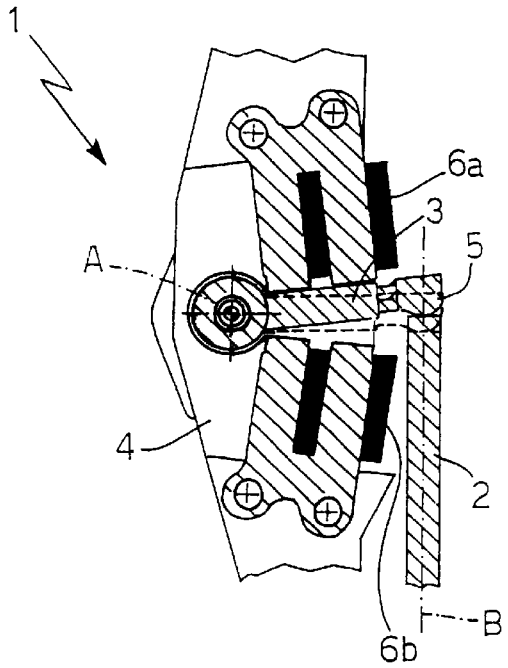
FIG. 1 is a lateral elevated view, partially in cross-section, of an electromagnetic actuator, and of the corresponding intake or exhaust valve.

With reference to FIG. 1, an electromagnetic actuator 1 is connected to an intake or exhaust valve 2 of an internal combustion engine, which for the sake of convenience is not shown. The actuator 1 comprises a small oscillating arm 3 made of ferromagnetic material, which has a first end pivoted on a fixed support 4, such as to be able to oscillate around an axis A of rotation, which is horizontal and is perpendicular to a longitudinal axis B of the valve 2. In addition, a second end 5 of the small oscillating arm 3 co-operates such as to abut an upper end of the valve 2, so as to impart to the latter reciprocal motion in a direction parallel to the longitudinal axis B.

The actuator 1 comprises a first and a second electromagnet 6*a*, 6*b* for opening, which are disposed on opposite sides of the body of the small oscillating arm 3, such as to be able to act by command, in sequence or simultaneously, to exert a net force F on the small oscillating arm 3, in order to make it rotate around the axis A of rotation.

In addition, a first and a second resilient element, for example a spring and a torsion bar, which for the sake of convenience are not shown, act such as to maintain the small oscillating arm 3 in a position of rest, in which it is equidistant from the polar heads respectively of the first and second electromagnets 6*a*, 6*b*.

Figure 2:
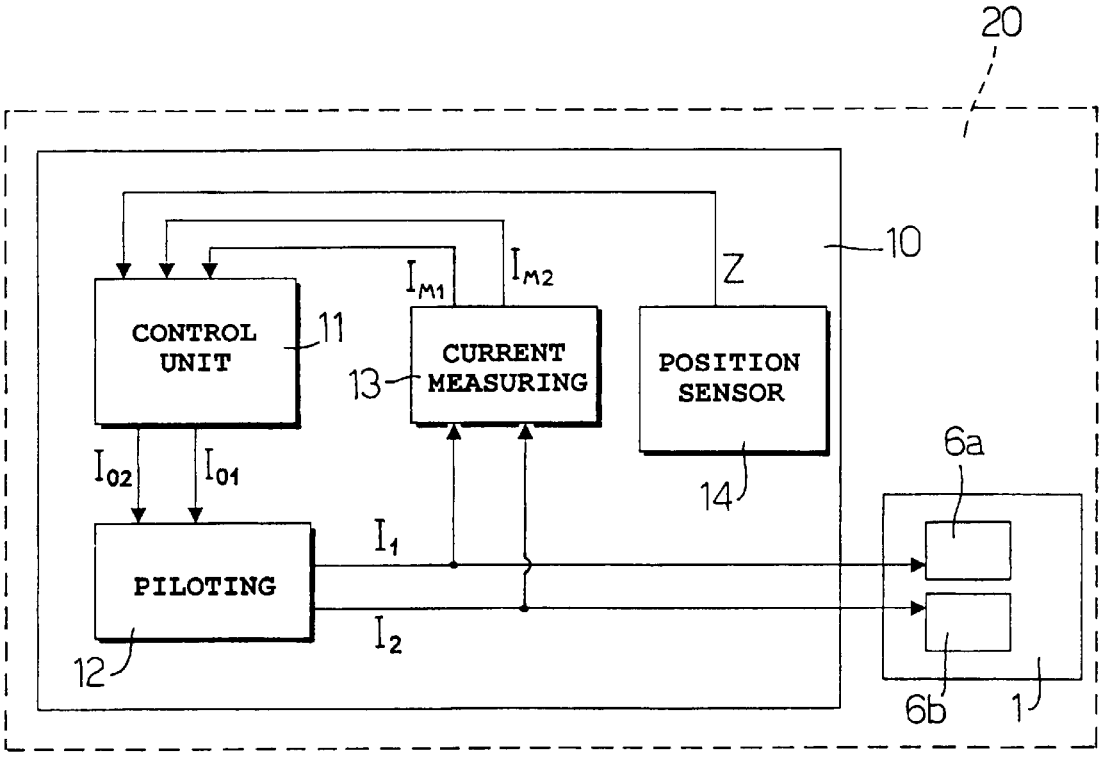
FIG. 2 is a simplified block diagram relating to the method for control according to the present invention.

As shown in FIG. 2, in an internal combustion engine 20, a system 10 for control of actuators 1, of the type described in FIG. 1, comprises a control unit 11, a piloting circuit 12, a current-measuring circuit 13, and a position sensor 14.

The control unit 11 is connected to the piloting circuit 12, to which, for each actuator 1 present, it supplies a first and a second objective value $I_{01}$, $I_{02}$ of currents which must be distributed. For the sake of simplicity, reference will be made hereinafter to a single actuator 1: this should not be considered as a limiting factor, since all the actuators 1 present can be controlled in a similar manner. The piloting circuit 12 has a first and a second output connected respectively to the first and the second electromagnets 6*a*, 6*b* of the actuator 1, in order to supply a first and a second current $I_1$, $I_2$, with values which are equivalent respectively to the first and the second objective values $I_{01}$, $I_{02}$.

The current-measuring circuit 13 has a first and a second input, which are connected respectively to the first and the second outputs of the piloting circuit 12, and it is also connected to the control unit 11. In particular, the current-measuring circuit 13 supplies to the control unit 11 respective measured values $I_{M1}$, $I_{M2}$ of the first and second currents $I_1$, $I_2$.

The position sensor 14, which has an output connected to the control unit 11, supplies to the control unit 11 itself a measurement of a real position Z of the valve 2.

The system 10 uses a method for control of electromagnetic actuators, for example as described in Italian patent application no. B099A000594 of Nov. 5th, 1999, filed in the name of the applicant.

This patent application relates to control of an electromagnetic actuator, substantially of the type of the actuator 1 described in FIG. 1, to which reference will continue to be made. According to the method described in the aforementioned application, a check with feedback is carried out on the real position Z and on a real speed V of the valve 2, using as a checking variable the net force F applied by means of the first and second electromagnets 6*a*, 6*b*, to the small oscillating arm 3 which actuates the valve 2 itself. For this purpose, by means of a model which is based on a dynamic system, there is calculation of an objective force $F_o$ to be exerted on the small oscillating arm, in accordance with the real position Z, the real speed V, a reference position $Z_R$ and a reference speed $V_R$ of the valve. In particular, the dynamic system is described by means of the following matrix equation:

$$\begin{bmatrix} \dot{Z} \\ \dot{V} \end{bmatrix} = \begin{bmatrix} 0 & 1 \\ K/M & B/M \end{bmatrix} \begin{bmatrix} Z \\ V \end{bmatrix} + \begin{bmatrix} 0 \\ 1/M \end{bmatrix} F \tag{2}$$

in which Z and V are the temporal derivatives respectively of the real position Z and the real speed V; F is the net force exerted on the small oscillating arm 3; K is a resilient constant, B is a viscous constant, and M is a total equivalent mass of the valve 2 and the small oscillating arm 3. In particular, the net force F and the real position Z represent respectively an input and an output of the dynamic system.

In addition, the objective force value $F_o$ is calculated according to the equation:

$$F_o=(N_1Z_R+N_2V_R)-(K_1Z+K_2V) \tag{3}$$

in which $N_1$, $N_2$, $K_1$ and $K_2$ are gains which can be calculated by applying well-known robust control techniques to the dynamic system represented by the equation (2).

Subsequently, the control unit 11 calculates the objective values $I_{01}$, $I_{02}$ of the currents $I_1$, $I_2$ to be distributed to the electromagnets 6*a*, 6*b*, in order for the net force F exerted on the small oscillating arm 3 to be equivalent to the objective force value $F_o$.

Figure 3:
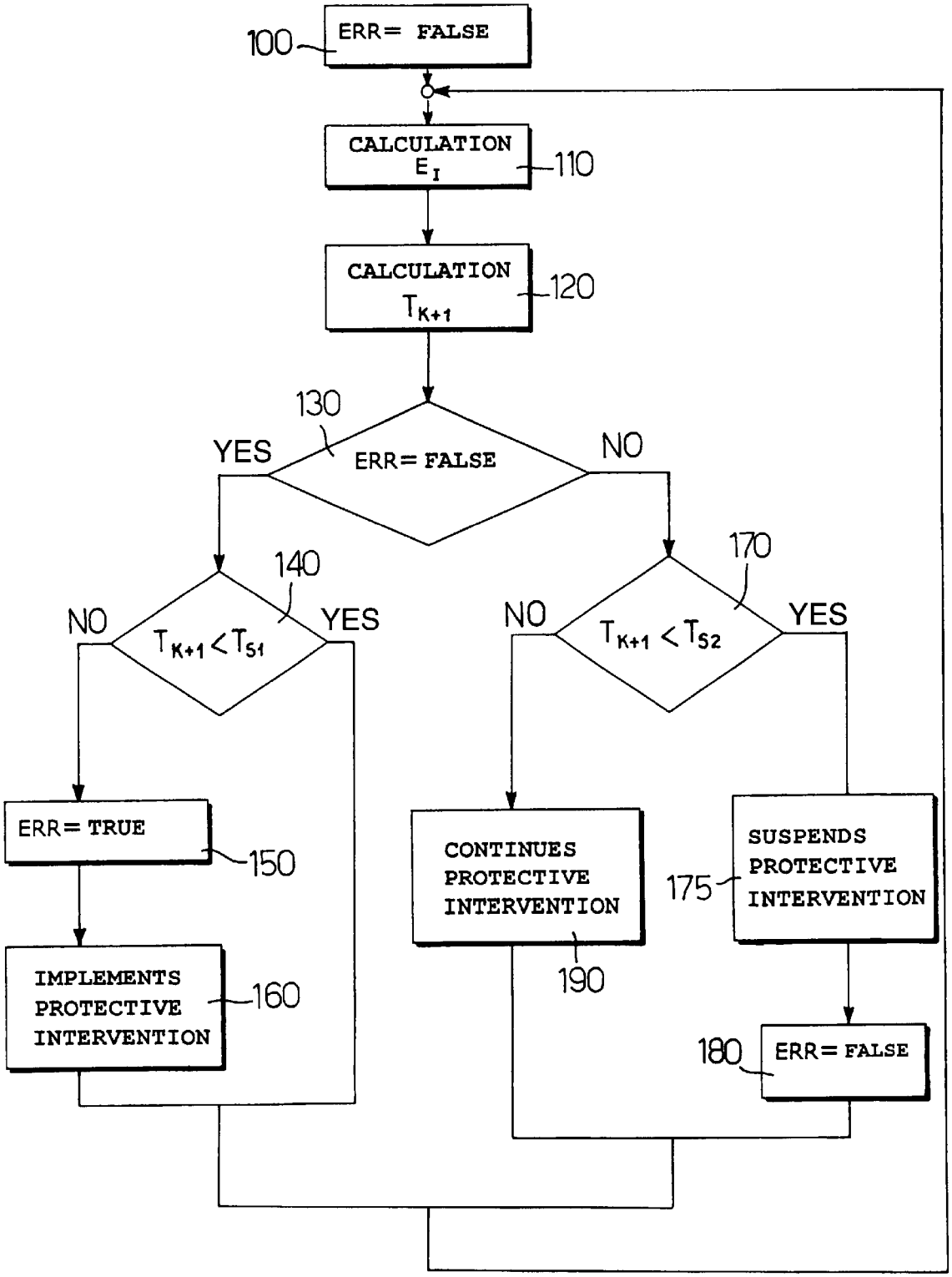
FIG. 3 is a flow chart relating to the method for control according to the present invention.

In addition, the control unit 11 implements the method according to the present invention, for protection against overheating, which will be described hereinafter with reference to FIG. 3. In addition, for the sake of simplicity, reference will be made to a single electromagnet of the actuator 1, for example the first electromagnet 6*a*, since the method can be applied in a manner which is altogether similar, also to the second electromagnet 6*b*.

A malfunctioning signal ERR inside the control unit 11 is initially set to a first logic value, for example a logic value "FALSE", which is indicative of a normal functioning condition of the actuator 1 (block 100).

Subsequently, calculation is carried out of the energy $E_I$ which is dissipated in the windings of the first electromagnet 6*a*, in a checking interval $\tau_1$, which has a pre-determined duration, and for example is equivalent to 50 ms (block 110). In detail, the measured value $I_{M1}$ of the first current $I_1$, is sampled, for example with a sampling period $\tau_2$ which is equivalent to 50 $\mu$s, throughout the duration of the checking interval $\tau_1$, such as to obtain a number N of sampled values $I_{D1}, I_{D2}, \ldots, I_{DN}$. The energy $E_I$ dissipated is calculated on the basis of the equation:

$$E_I = \sum_{I=1}^{N} RI_{DI}^2\tau_2 \tag{1}$$

in which R is an equivalent series resistance of the windings of the first electromagnet 1, the value of which can be determined experimentally.

Subsequently, estimation is carried out of an updated temperature value $T_{K+1}$ of the windings of the first electromagnet 6*a*, in accordance with a present temperature value $T_K$ and with the energy dissipated $E_I$ (block 120). In particular, the updated temperature value $T_{K+1}$ is calculated according to the equation:

$$T_{K+1}=(1-A_1A_2\tau_1)T_K+A_1\tau_1E_I \tag{2}$$

which can be obtained from the following thermal balancing equation:

$$\frac{T_{K+1}-T_K}{\tau_1} = A_1(E_I - A_2T_K) \tag{3}$$

In the equations (2) and (3), $A_1$ and $A_2$ are a first and a second coefficient, which take into account the thermal capacity of the windings of the first electromagnet 6*a*, and conductive and convective thermal exchange factors. The first and the second coefficients $A_1$, $A_2$ depend on the structural characteristics of the actuator 1 (geometry and materials), are pre-determined, and can be established experimentally.

After the updated temperature value $T_K$ has been estimated, a test is carried out in order to check whether the malfunctioning signal ERR is at the first logic value ("FALSE", block 130).

If this is the case (YES output from block 130), a second test is carried out in order to verify that the updated temperature value $T_{K+1}$ is lower than a first threshold $T_{S1}$ (block 140). If this condition is met (YES output from block 140), there is a return to execution of calculation of the energy $E_I$ dissipated in the windings of the first electromagnet 6*a* in the checking interval $\tau_1$ (block 110). Otherwise (NO output from block 140), the malfunctioning signal ERR is set to a second logic value, indicative of a condition of overheating (for example a logic value "TRUE", block 150). In addition, protection intervention is implemented (block 160), which consists for example of disabling the actuator 1, and stopping the engine 20 temporarily, such as to prevent further dangerous heating of the windings of the first electromagnet 6*a*. However, the control unit 11 can also be supplied with power when the engine 20 is not running, and is thus able to continue execution of the protection process, and to return to execution of calculation of the energy $E_I$ dissipated in the windings of the first electromagnet 6*a* (block 110).

If the malfunctioning signal ERR is at the second logic value ("TRUE", NO output from block 130), a further test is carried out in order to check that the updated temperature value $T_{K+1}$ is lower than a second threshold $T_{S2}$, which is lower than the first threshold $T_{S1}$ (block 170). If this is the case (YES output from block 170), the protection intervention is suspended (block 75), and the malfunctioning signal ERR is set once again to the first logic value ("FALSE", block 180), such as to re-enable use of the actuator 1, and starting of the engine 20. If, on the other hand, the updated temperature value $T_{K+1}$ is higher than the second threshold $T_{S2}$ (NO output from block 170), the protection intervention is continued (block 190). Subsequently, there is return to execution of calculation of the energy $E_I$ dissipated in the windings of the first electromagnet 6*a* (block 110).

As previously stated, the method for protection is applied in each actuator 1, both for the first electromagnet 6*a*, and for the second electromagnet 6*b*. By this means, the temperatures of all the windings are estimated and verified at each checking interval $\tau_1$, i.e. approximately every 50 ms.

The advantages of the present invention are apparent from the foregoing description.

Firstly, the risk of breakages of the windings of the electromagnets present in the actuators is substantially reduced. Since in fact the checking interval $\tau_1$ has a short duration, updating of the estimates of the temperatures of the windings is carried out with a high frequency. Consequently, any overheating is detected in good time, and the immediate suspension of distribution of currents prevents the actuators from being damaged.

In addition, the engine can be restarted as soon as the temperature of the overheated windings returns within safety limits, i.e. below the second threshold $T_{S2}$. This is particularly advantageous if the overheating can be attributed to causes which are not permanent, and do not necessarily require maintenance intervention.

Finally, it is apparent that modifications and variants can be made to the method described, without departing from the context of the present invention.

In particular, it is possible to carry out various protection interventions on the basis of indication of a condition of overheating in one of the actuators 1 present (blocks 160, 190). For example, the control unit 11 can disable the actuator 1 which is not functioning correctly, and can exclude only the corresponding cylinder, By this means, there is therefore prevention of damage to the overheated windings, and the further advantage is obtained of not stopping the propulsion unit immediately, and of making it operate temporarily in emergency conditions.

What is claimed is:

1. Method for protection against overheating of electromagnetic actuators for actuation of intake and exhaust valves in internal-combustion engines, in which an actuator (1) of an engine (20) is connected to a respective intake or exhaust valve (2), and comprises a mobile unit (3) which is actuated magnetically, in order to control the movement of the said valve (2), and a first and a second electromagnet (6*a*, 6*b*), which are disposed on opposite sides of the said mobile unit (3); the said actuator (1) also being connected to a control unit (11), via piloting means (12), which supply at least one current ($I_1$, $I_2$), and to current-measuring means (13); the said current-measuring means supplying to the said control unit (11) measured values ($I_{M1}$, $I_{M2}$) of the said at least one current ($I_1$, $I_2$);

the method being characterised in that it comprises the steps of:

a) estimating (120) for each of the said first and second electromagnets (6*a*, 6*b*), a temperature value $T_{K+1}$ which is updated on the basis of a present temperature value $T_K$ and of the said measured values ($I_{M1}$, $I_{M2}$) of the said at least one current ($I_1$, $I_2$); and b) checking (140) whether the updated temperature value $T_K$ is lower than a first threshold ($T_{S1}$); and c) implementing protective action (160), if the said updated temperature value $T_K$ is higher than the said first threshold ($T_{S1}$).

2. Method according to claim 1, characterised in that the said step a) of estimating (120) the said updated temperature value $T_{K+1}$ is obtained by using the equation $$T_{K+1}=(1-A_1A_2\tau_1)T_K+A_1\tau_1E_I$$

in which $\tau_1$ is a checking interval, $E_I$ is energy dissipated in the said checking interval $\tau_1$, and $A_1$ and $A_2$ are a first and a second pre-determined coefficient.

3. Method according to claim 2, characterised in that the said step a) of estimating (120) the said updated temperature value $T_{K+1}$ is preceded by the step of:

a1) calculating (110) energy $E_I$ dissipated in the said checking interval $\tau_1$, according to the said measured values ($I_{M1}$, $I_{M2}$) of the said at least one current ($I_1$, $I_2$).

4. Method according to claim 3, characterised in that the said step a1) of calculating (110) the said energy $E_I$ dissipated in the said checking interval $\tau_1$ comprises the steps of:

a11) obtaining sampled values ($I_{D1}$, $I_{D2}$, . . . , $I_{DN}$) of the said measured values ($I_{M1}$, $I_{M2}$) of the said at least one current ($I_1$, $I_2$); and a12) calculating the said energy $E_I$ dissipated in the said checking interval $\tau_1$ according to the equation:

$$E_I = \sum_{l=1}^{N} RI_{Dl}^2\tau_2$$

which R is an equivalent resistance and $\tau_2$ is a sampling period.

5. Method according to claim 2, characterised in that the said checking interval $\tau_1$ is equivalent to 50 ms.

6. Method according to claim 1, characterised in that the said step c) of actuating the said protection intervention (160) comprises the steps of:

c1) disabling the said actuator (1); and c2) stopping the said engine (20).

7. Method according to claim 1, characterised in that the said step c) of actuating the said protection intervention (160) comprises the steps of:

c3) continuing the said protection intervention (190), if the said updated temperature value $T_K$ is higher than a second threshold ($T_{S2}$), the said second threshold ($T_{S2}$) being lower than the said first threshold ($T_{S1}$); and c4) interrupting the said protection intervention (175), if the said updated temperature value $T_K$ is lower than the said second threshold ($T_{S2}$).

* * * * *